United States Patent [19]

Bihler et al.

[11] Patent Number: 4,580,329

[45] Date of Patent: Apr. 8, 1986

[54] PROCESSING MACHINE FOR WORKPIECES

[75] Inventors: Otto Bihler, Schleiferweg 2, D-8959 Halblech, Fed. Rep. of Germany; Eduard Brüller, Trimbach, Switzerland

[73] Assignee: Otto Bihler, Fed. Rep. of Germany

[21] Appl. No.: 613,588

[22] Filed: May 23, 1984

[30] Foreign Application Priority Data

May 27, 1983 [DE] Fed. Rep. of Germany ..... 3319380

[51] Int. Cl.[4] ..... B23P 23/00

[52] U.S. Cl. ..... 29/560; 29/26 A; 72/442; 72/449; 74/425; 83/618; 212/210; 408/24

[58] Field of Search ..... 83/618; 74/665 H, 425, 74/416, 384; 29/26 A, 560, 34 R; 408/24; 72/440, 442, 444, 449, 454, 404, 478, 371, 381; 403/380, 354, 359; 212/210

[56] References Cited

U.S. PATENT DOCUMENTS

| | | | |
|---|---|---|---|
| 1,173,289 | 2/1916 | McKee et al. | 403/359 |
| 2,569,744 | 10/1951 | Cecka | 74/425 |
| 2,965,920 | 12/1960 | Whittum | 72/237 |
| 2,976,702 | 3/1961 | Pietsch | 403/359 |
| 3,257,835 | 6/1966 | Coter et al. | 72/38 |
| 3,709,025 | 1/1973 | Laurencin | 72/421 |
| 3,762,234 | 10/1973 | Hoglund | 72/425 |
| 3,783,792 | 1/1974 | Cullom | 212/210 |
| 4,196,501 | 4/1980 | Shimajiri et al. | 29/26 A |
| 4,270,253 | 6/1981 | Herb et al. | 29/26 A |

FOREIGN PATENT DOCUMENTS

| | | | |
|---|---|---|---|
| 1019526 | 11/1957 | Fed. Rep. of Germany . | |
| 1887318 | 2/1964 | Fed. Rep. of Germany . | |
| 2347498 | 4/1975 | Fed. Rep. of Germany . | |
| 2457048 | 6/1976 | Fed. Rep. of Germany . | |
| 2625022 | 12/1976 | Fed. Rep. of Germany . | |
| 555199 | 6/1923 | France | 74/384 |
| 0060757 | 5/1980 | Japan | 74/425 |
| 344703 | 3/1931 | United Kingdom | 74/56 |

*Primary Examiner*—Francis S. Husar
*Assistant Examiner*—Robert Showalter
*Attorney, Agent, or Firm*—Toren, McGeady, Stanger, Goldberg & Kiel

[57] ABSTRACT

A workpiece processing machine comprises a stationary main frame 10 with at least one main processing plane G. On the one side of this main processing plane there are arranged worm shafts 15, 16, 17 and 18 extending with their axes substantially parallel with the main processing plane G, mounted in the stationary main frame 10 and connected for drive with one another. On the other side of the main processing plane G there are provided securers for the securing of processing units 25 on the stationary main frame 10. To each worm shaft there is allocated at least one main power take-off position 15*a*, 16*a*, 17*a*, 18*a* for the drive connection of a processing unit 25 with the respective worm shaft 15, 16, 17, 18 through a worm wheel, meshing with the worm shaft, with worm wheel axis perpendicular to the main processing plane G. At least three worm shafts connected for drive are arranged along mutually adjoining sides of a polygonal line.

80 Claims, 19 Drawing Figures

PROCESSING MACHINE FOR WORKPIECES

BACKGROUND OF THE INVENTION

The invention relates to a workpiece processing machine with a stationary main frame (10) hving at least one main processing plane (G, H,) worm shafts (15, 16, 17, 18) arranged on the one side of this main processing plane (G, H) with their axes substantially parallel with the main processing plane, mounted in the stationary main frame (10) and connected with one another for drive securing means (14) arranged on the other side of the main processing plane for the securing the processing units (25, 29) on the stationary main frame and—allocated to each worm shaft (15, 16, 17, 18)—at least one main power take-off position (15*a*, 16*a*, 17*a*, 18*a*) for the drive connection of a processing unit (25, 29) with the respective worm shaft (15, 16, 17, 18) through a worm wheel (22) meshing with the worm shaft with the worm wheel axis perpendicular to the main processing plane (G, H).

SUMMARY OF THE INVENTION

Such a workpiece processing machine was the object of an earlier U.S. Patent application Ser. No. 463,556, to the same inventors, now abandoned.

The invention is based upon the problem of so developing a workpiece processing machine of the kind according to the classification that processing units can be fitted in the largest possible number of different positions and with different working directions in relation to the workpiece to be processed, without complicated drive transmissions.

For the solution of this problem at least three worm shafts connected for drive are arranged along mutually adjoining sides of a polygonal line.

Further developments of the invention are set forth in the following description.

The additional problems preceding these further development measures and the resultant advantages appear from the description of the Figures.

The accompanying FIGURES explain the invention by reference to examples of embodiment.

DETAILED DESCRIPTION OF THE INVENTION

Figure 1:
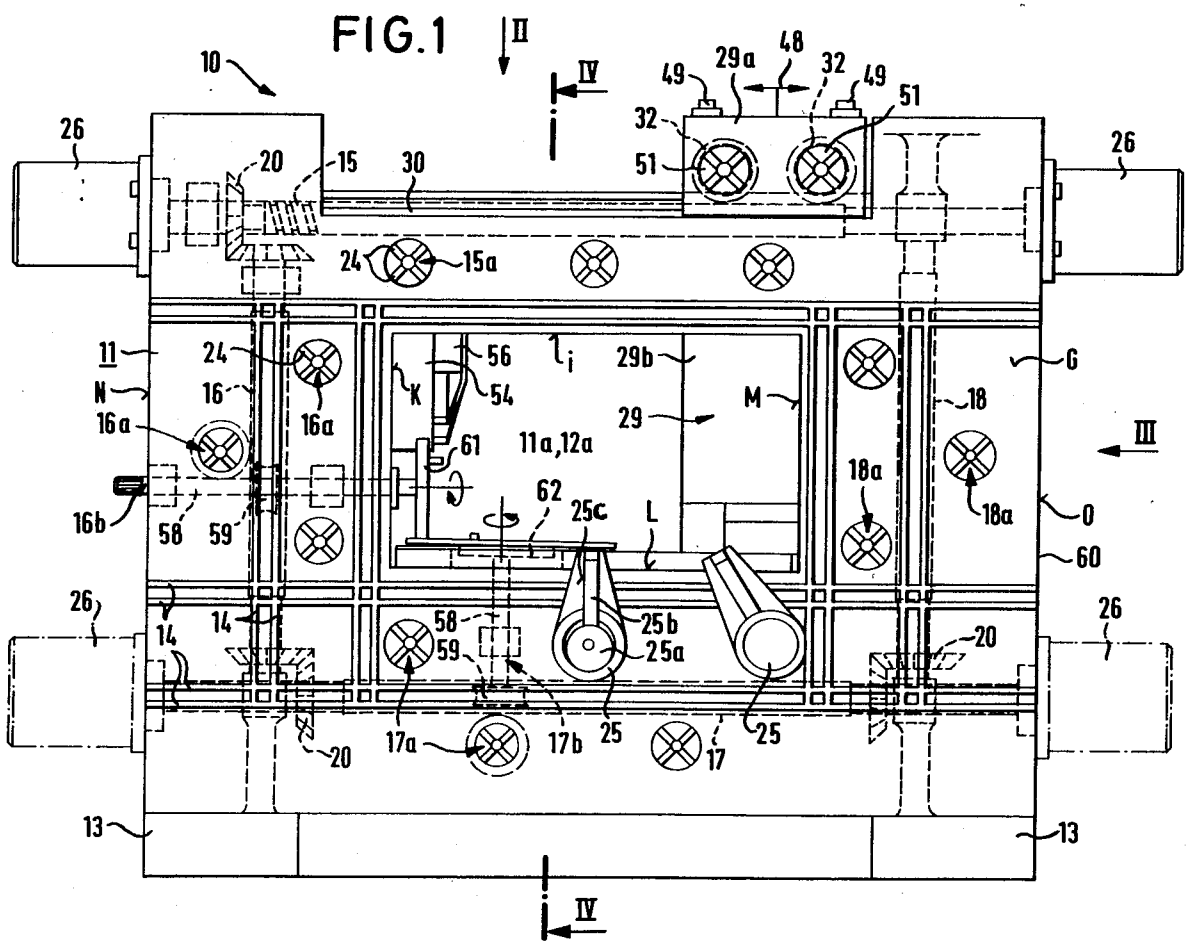
FIG. 1 represents a front view of a workpiece processing machine according to the invention.
Figure 3:
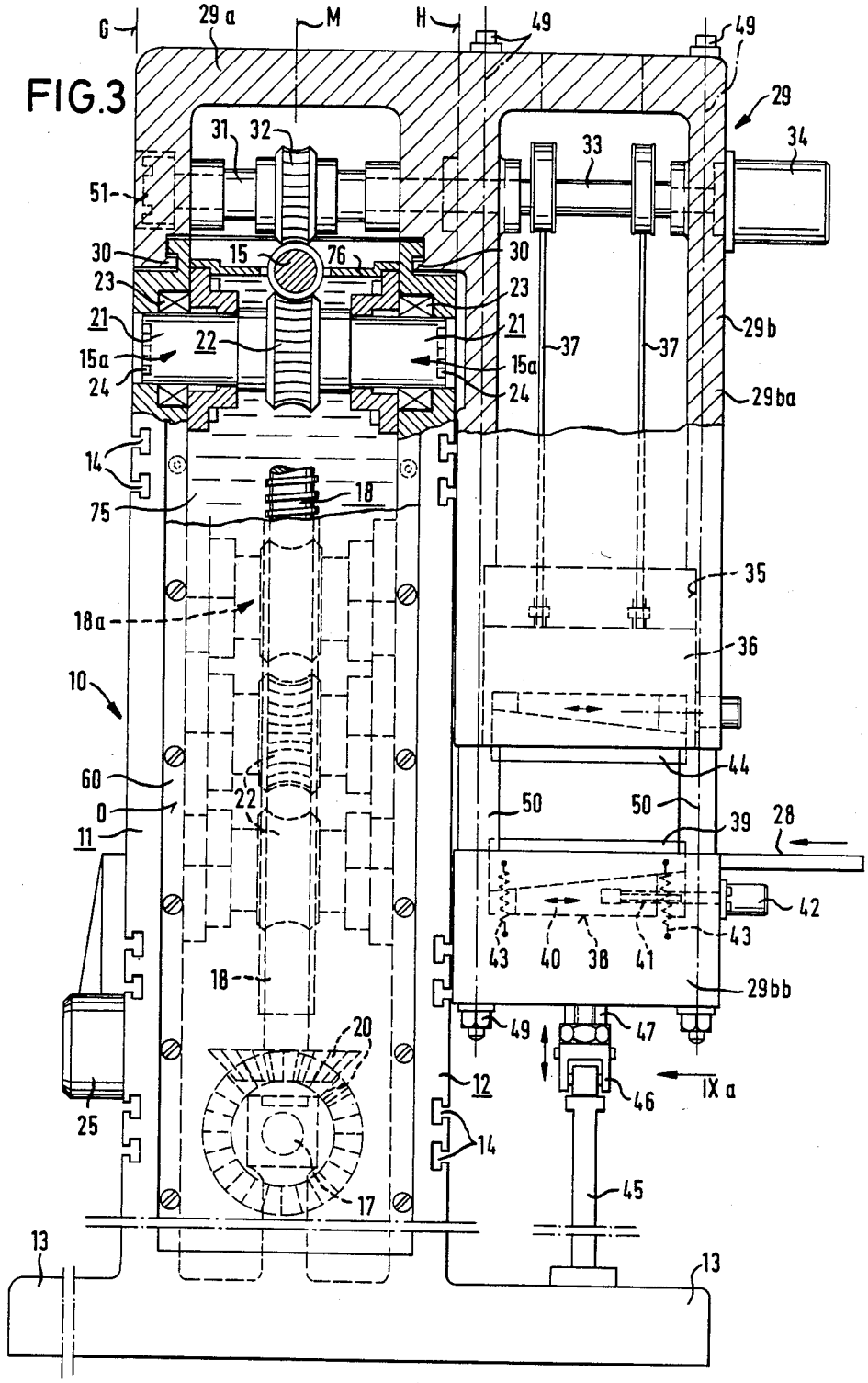
FIG. 3 represents a side view of the machine in the direction of the arrow III in FIG. 1, partially broken away.

In FIG. 1 a main frame is designated quite generally by 10. This frame 10, as may be seen from FIG. 3, is formed essentially by two main processing panels 11 and 12 which are produced together with floor support spars 13 as a one-piece casting. The two main processing panels 11 and 12 define two main processing planes G and H (FIG. 3). In the main processing panels 11 and 12 there are provided dovetail grooves 14 for the securing of processing units or other machine accessories. In the main frame 10 four worm shafts 15, 16, 16 and 18 are arranged in the central plane M between the two main processing planes G and H, between the two main processing panels 11 and 12. The shaft arrangement is seen in detail from FIG. 5. The shafts 15, 16, 17 and 18 are mounted in bearings 19 which are produced integrally with the casting comprising the main processing panels 11 and 12.

The four worm shafts 15 to 18 are arranged along a rectangular polygon line. The shafts 15 and 16, 16 and 17 and 17 and 18 are connected with one another for drive by bevel gear stages 20. Several main power take-off positions 15*a*, 16*a*, 17*a* and 18*a* are allocated for each of the worm shafts 15, 16, 17, and 18, namely in each of the main processing panels 11 and 12. The main power take-off positions 15*a* to 18*a* serve for the drive of processing units which can be secured by mens of the dovetail grooves 14 of the main processing panels 11 and 12.

In FIG. 3 it is illustrated how two main power take-off positions 15*a* in the two main processing panels 11 and 12 are formed in detail. There one may see a worm wheel shaft 21 with a worm wheel 22. The worm wheel shaft 21 is rotatably mounted in bearings 23 in the two main processing panels 11 and 12. The worm wheel 22 is connected fast in rotation with the worm wheel shaft 21 and is in drive engagement with the worm shaft 15. The worm of the worm shaft 15 and the toothing of the worm wheel 22 are formed so that the worm wheel shaft 21 rotates with a rotation rate corresponding to about one-fifth of the rotation rate of the worm shaft 15.

The worm wheel shafts 21 are provided at their ends lying in the main processing planes G and H with coupling devices 24 which are intended to engage with corresponding counter-coupling devices of attachable processing units, so that these processing units can be driven by the worm wheel shafts 21. Details of these coupling devices will be discussed further in connection with FIG. 11.

In FIGS. 1 and 3 there are seen, represented diagrammatically, several bending units 25 which are driven there from the worm shaft 17 through pertinent main power take-off positions 17*a*. The bending units 25, as indicated diagrammatically in FIG. 1, are formed for example each by a cam 25*a*, a bending ram 25*b* and a bending ram guide 25*c*, the cam 25*a* being driven from the worm shaft 17 through the pertinent power take-off position 17*a*.

As may be seen from FIG. 1, main power take-off positions 16*a*, 17*a* and 18*a* are allocated on both sides of the respective worm shaft to the worm shafts 16, 17 and 18, the main power take-off positions on the one side being staggered in relation to the main power take-off positions on the other side. In this way a great multiplicity of selection results for the position of the bending units according to the bending task to be performed in each case.

As may be seen from FIG. 1, the two ends of the worm shaft 15 and possibly also the two ends of the worm shaft 17 are connected each with a hydraulic drive motor 26. The hydraulic motors 26 are connected to a common pressure supply pump 27 (see FIG. 12) and in fact the hydraulic drive motors 26 can be fed from the hydraulic pressure supply pump 27 without quantity divider. Due to the presence of a plurality of hydraulic drive motors the worm shafts are relieved of load and the torsions of the worm shafts are largely excluded. At this point it should also be mentioned that the torques acting on the worm shafts 15 to 18 are in any case relatively small in comparison with the torques taken from the processing units, since the worm shafts 15 to 18 rotate at a substantially greater rate than the worm wheels 22 and their worm wheel shafts 21.

The engagement between the worm wheels 22 and the worm shafts 15 to 18 is free from flank play, since in each case several teeth of the worm wheels 22 are in engagement with worm turns of the worm shafts 15 to 18; this is a substantial advantage over the torque transmission by pairs of spur gears, where in unfavourable situations of engagement in each case only one tooth of each wheel is in engagement with one tooth of the other wheel.

Thus with the formation in accordance with the invention an exact play-free synchronization of all power take-off positions, that is worm wheel shafts 21, with the worm shafts 15 to 18 and the drive motors 26 is achieved.

Figure 2:
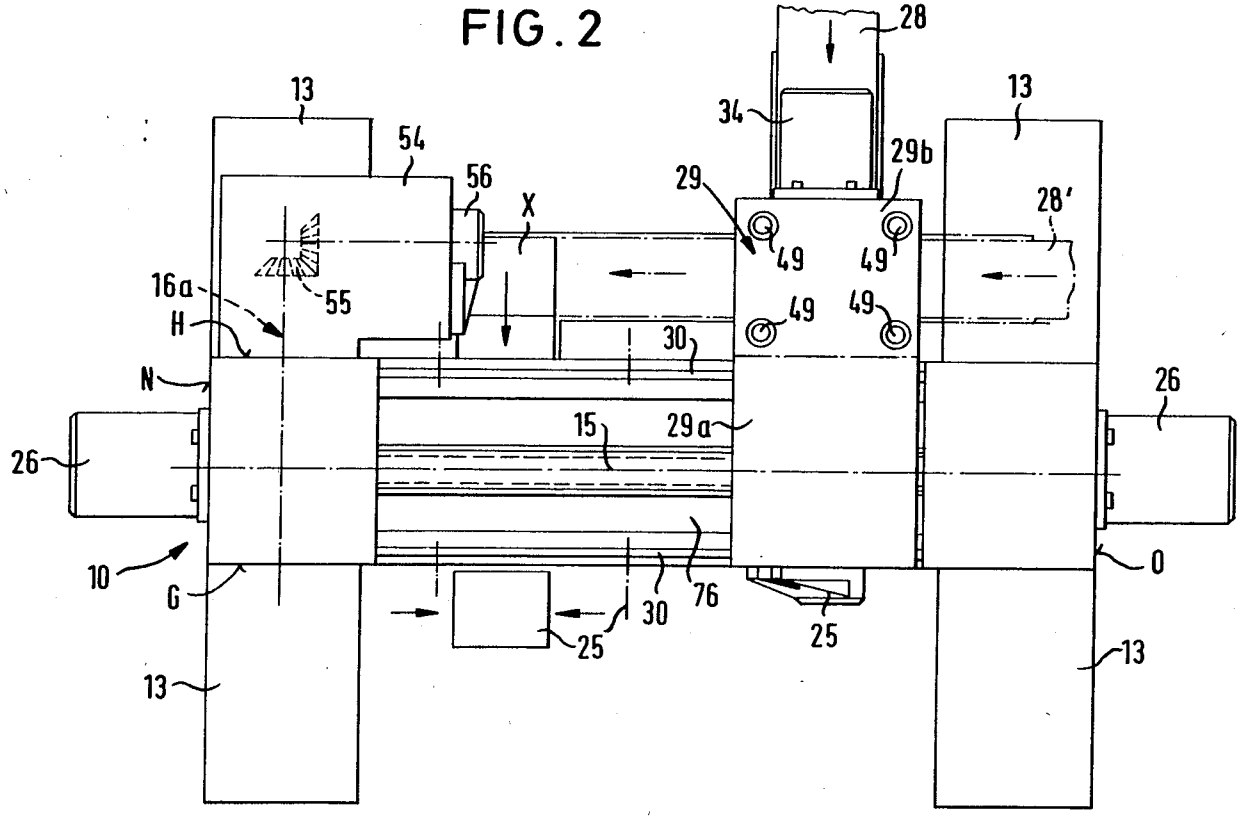
FIG. 2 represents a plan view of the machine according to FIG. 1 in the direction of the arrow II in FIG. 1.

The machine as described hitherto is intended and adapted for workpieces to be processed in both main working planes G and H. The workpieces can be obtained for example from strip metal material which is fed to the main processing plane H (FIG. 2). In FIG. 2 a strip material feed 28 is represented in solid lines and a strip material feed 28' in dot-and-dash lines. This is intended to signify that fundamentally a strip supply is possible parallel to the main processing planes G and H but also perpendicular to the main processing planes G and H. The selection of the strip feed direction is here dependent upon the workpiece to be produced in each case. It is here to be noted that specific bending operations parallel to the rolling direction of the strip and other bending operations perpendicular to the rolling direction of the strip are to be carried out.

In order to obtain individual cut-out shapes from the strip material which is fed according to FIG. 2, on the machine main frame 10 a punch press 29 is arranged which, as may be seen from FIG. 3, is formed as an L-shaped unit with a leg 29*a* directed transversely of the main planes G and H and a leg 29*b* hanging downwards from the leg 29*a*. The leg 29*a* is guided on the upper edges of the main processing panels 11 and 12 by linear guides 30. The linear guides 30 are here made so that the leg 29*a* cannot tilt away from the main processing panels 11 and 12. Two worm wheel shafts 31 with worm wheels 32 are rotatably mounted in the leg 29*a* (in FIG. 3 only one of these worm wheels is illustrated). The worm wheels 32 mesh with the worm shaft 15 which is upwardly exposed between the upper edges of the main processing panels 11 and 12. The worm wheel shafts 31 are coupled with two eccentric drive shafts 33 which are mounted at both ends in the leg 29*b*. On the exposed side of the leg 29*b* on each of the eccentric drive shafts 33 there are arranged further additional hydraulic motors which relieve the eccentric drive shafts 33 of torque. It is also possible to couple the two eccentric drive shafts 33 lying one behind the other in FIG. 3, through a connecting gear wheel with one another and to permit an additional hydraulic motor 34 to act upon this connecting gear wheel.

The leg 29*b* forms a press frame with a press frame upper part 29*ba* and a press frame under part 29*bb*. In the press frame upper part 29*ba* a vertical guide 35 is formed for a press ram 36. The press ram 36 is movable upwards and downwards by the eccentric drive shafts 33 through a total of four connecting rods 37.

A press table 38 is formed on the press frame under part 29*bb*. A lower tool clamping plate 39 is secured on the press table 38. This tool clamping plate 39 is adjustable in height by a wedge plate 40. The wedge plate 40 lies on the press table 38 and in turn carries the lower tool clamping plate 39. The wedge plate 40 is displaceable by a spindle drive 41 for the purpose of height adjustment of the tool clamping plate 39. The spindle drive 41 is connected with a hydraulic spindle drive motor 42. The tool clamping plate 39 is pressed by springs 43 against the wedge plate 40, the latter at the same time being pressed against the press table 38. After the height adjustment of the lower tool clamping plate 39 has taken place this plate is clamped fast in the position reached, by clamping means (not shown).

An upper tool clamping plate 44 is fitted on the press ram 36 for height adjustment in analogous manner by a wedge plate.

Figure 9A:
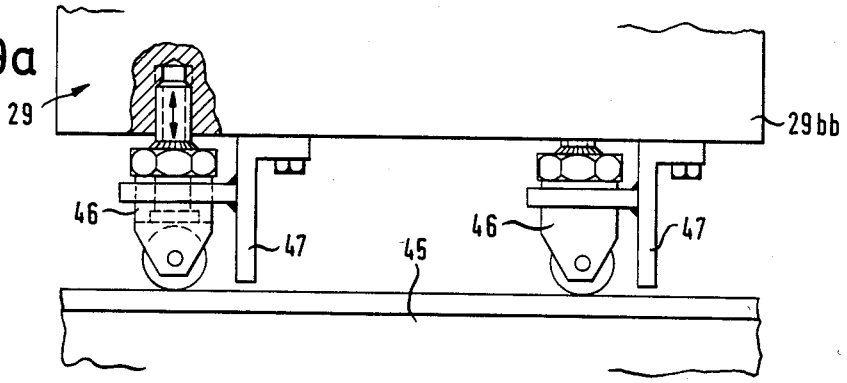
FIG. 9*a* represents a diagrammatic detail illustration of FIG. 3 in the direction of the arrow IXa of FIG. 3.

The lower press frame part 29*bb* is supported on a support rail 45 which is secured on the floor support spars 13 of the main frame 10. The press frame under part 29*bb* is supported, as may be seen from FIG. 9*a*, on the support rail 45 by two roller bearing pedestals 46 of adjustable height, when the punch press 29 is to be displaced in the longitudinal direction of the linear guide 30. When a specific end position of the punch press 29 is reached, the roller bearing pedestals 46 are displaced upwards in FIG. 9*a* so that support shoes 47 come into engagement with the support rail 45 and thus the punch press 29 is non-displaceably supported on the support rail 45. Naturally still further securing means can be provided to secure the punch press 29 in the longitudinal direction of the linear guide 30 in operation.

The worm wheels 32 serving in operation for the rotation of the eccentric guide shafts 33 and thus for the upward and downward movement of the press ram 36 can also be used for the displacement of the punch press 29 in the direction of the arrow 48 in FIG. 1, that is to say perpendicularly of the plane of the drawing in FIG. 3. For this purpose it is necessary only to block the worm wheels 32 or the eccentric drive shafts 33 coupled with them. Then by rotation of the worm shaft 15 the punch press 29 can be displaced. Alternatively for the displacement of the punch press 29 in the direction of the arrow 48 in FIG. 1 it is also possible to make the worm shaft 15 fast and to drive the worm wheels 32 from the hydraulic motor 34, so that the worm shaft 15 acts as a rack.

The press frame upper part 29*ba* is connected with the press frame under part 29*bb* by initially stressed tie rods 49. These tie rods 49 pass through distance sleeves 50 which are arranged between the press frame upper part 29*ba* and the press frame under part 29*bb*. The tie rods 49 are subject to an initial stress which corresponds to the greatest press forces to be expected. The punch press 29 can be designed for example for up to 100 tons. The forces occurring in the punch press 29 are taken up by the tie rods 49 and not transmitted to the main machine frame 10.

The distance sleeves 50 and the tie rods 49 are exchangeable for the adaptation of the press to workpieces of different heights; the fine adjustment is effected by the wedge plates 40.

The leg 29*a* and the leg 29*b* can be produced as a one-piece casting; they can however also be divided approximately in the main processing plane H and screwed to one another.

Figure 9:
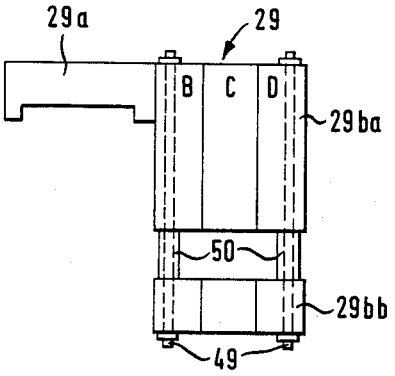
FIG. 9 and FIG. 10 represent diagrammatic detail representations of FIG. 3.
Figure 10:
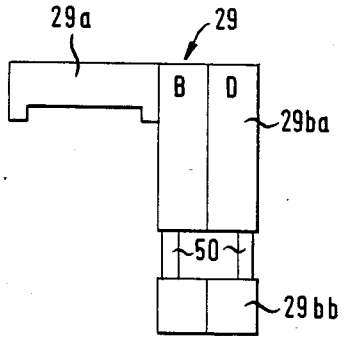

The press frame upper part 29*ba*, as may be seen from FIG. 9, can be assembled from three parts B, C and D placed together in sandwich manner and connected with one another, the vertical guide being formed in the parts B and D. By insertion or omission of the part C according to FIGS. 9 and 10 respectively then the width of the vertical guide 35 can be varied perpendicularly of the main processing planes G and H, so that press rams 36 of different widths can be used. The press frame under part 29*bb* can also be assembled in a corresponding manner.

The worm wheel shafts 31 in the punch press 29 provide additional power take-off positions 51 at their left ends in FIG. 3 for one or more processing units (not shown) which are continuously adjustable with the punch press 29.

Figure 4:
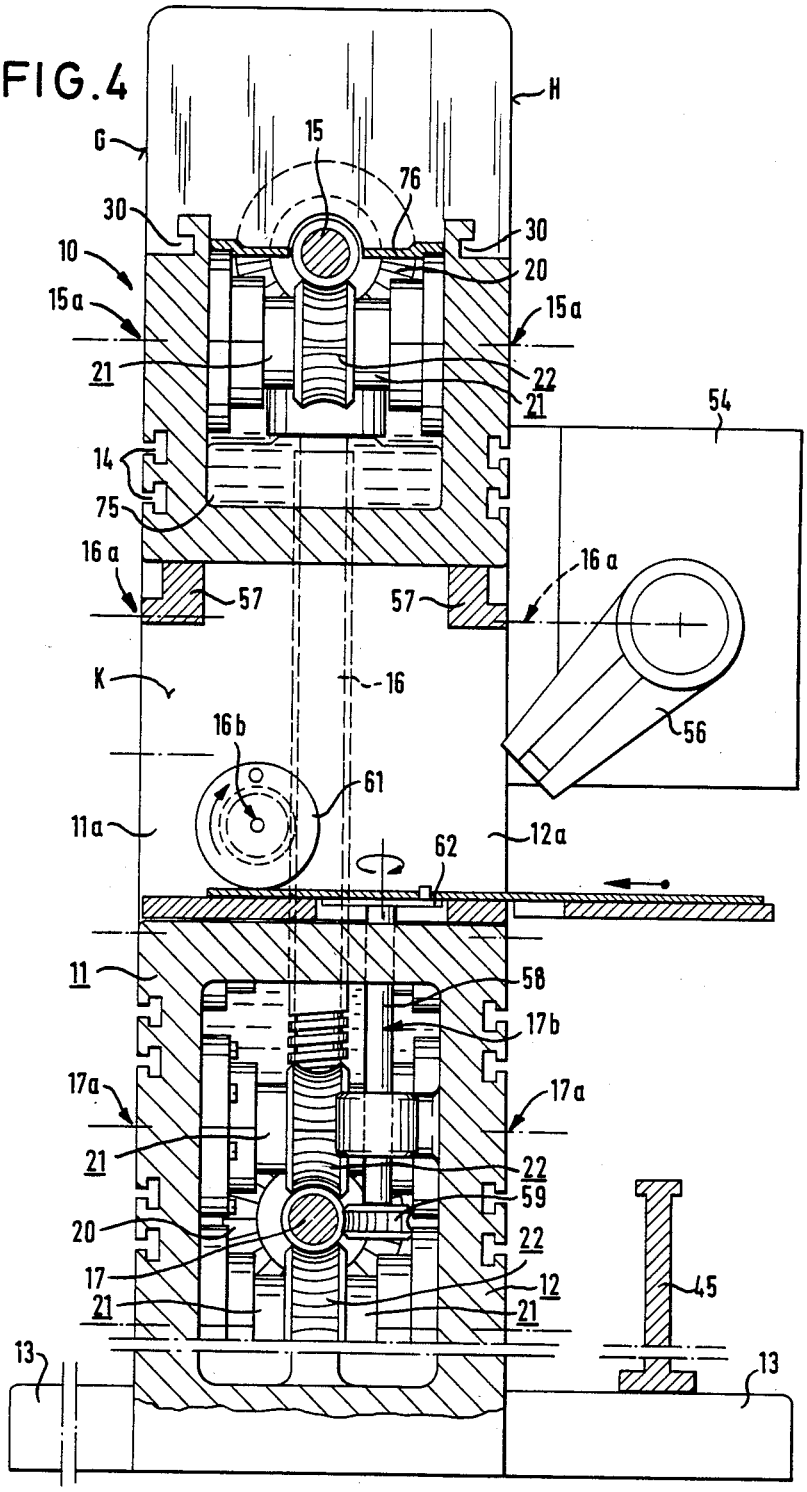
FIG. 4 represents a section along the line IV—IV in FIG. 1.
Figure 14:
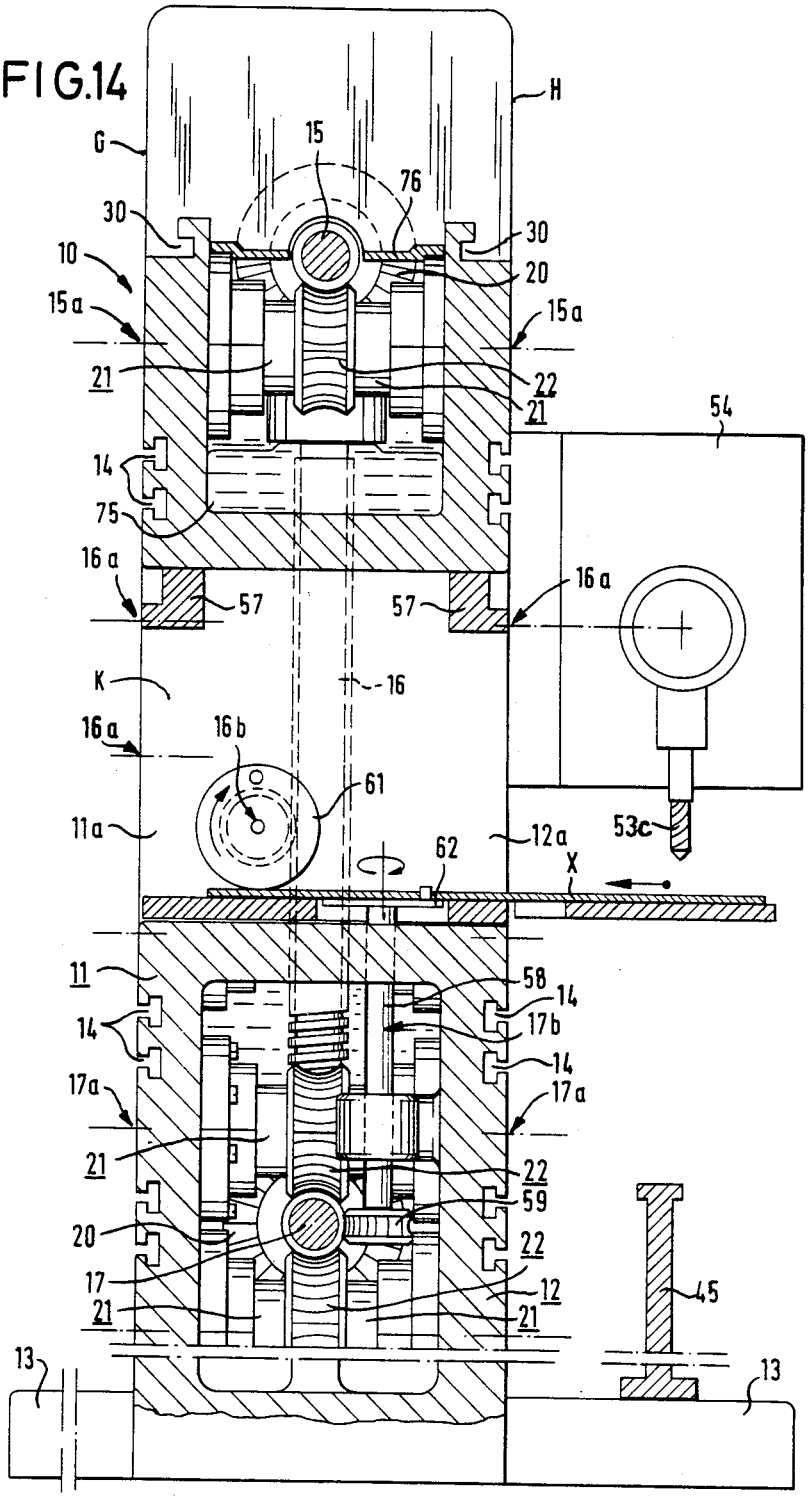
FIGS. 14, 16, 17, and 18 represents a section along the line IV—IV in FIG. 1 in a machine equipped with other processing units.
Figure 16:
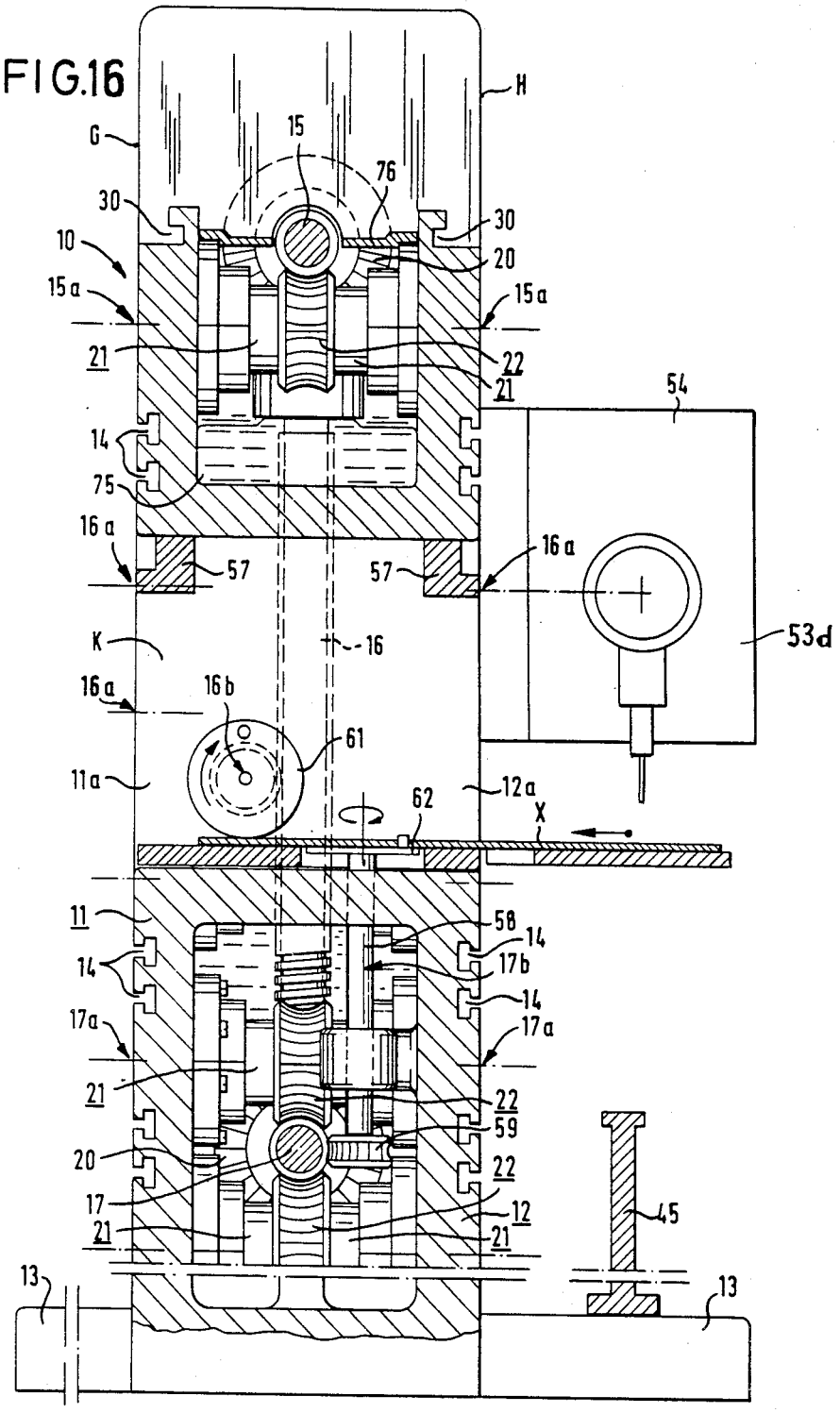
Figure 17:
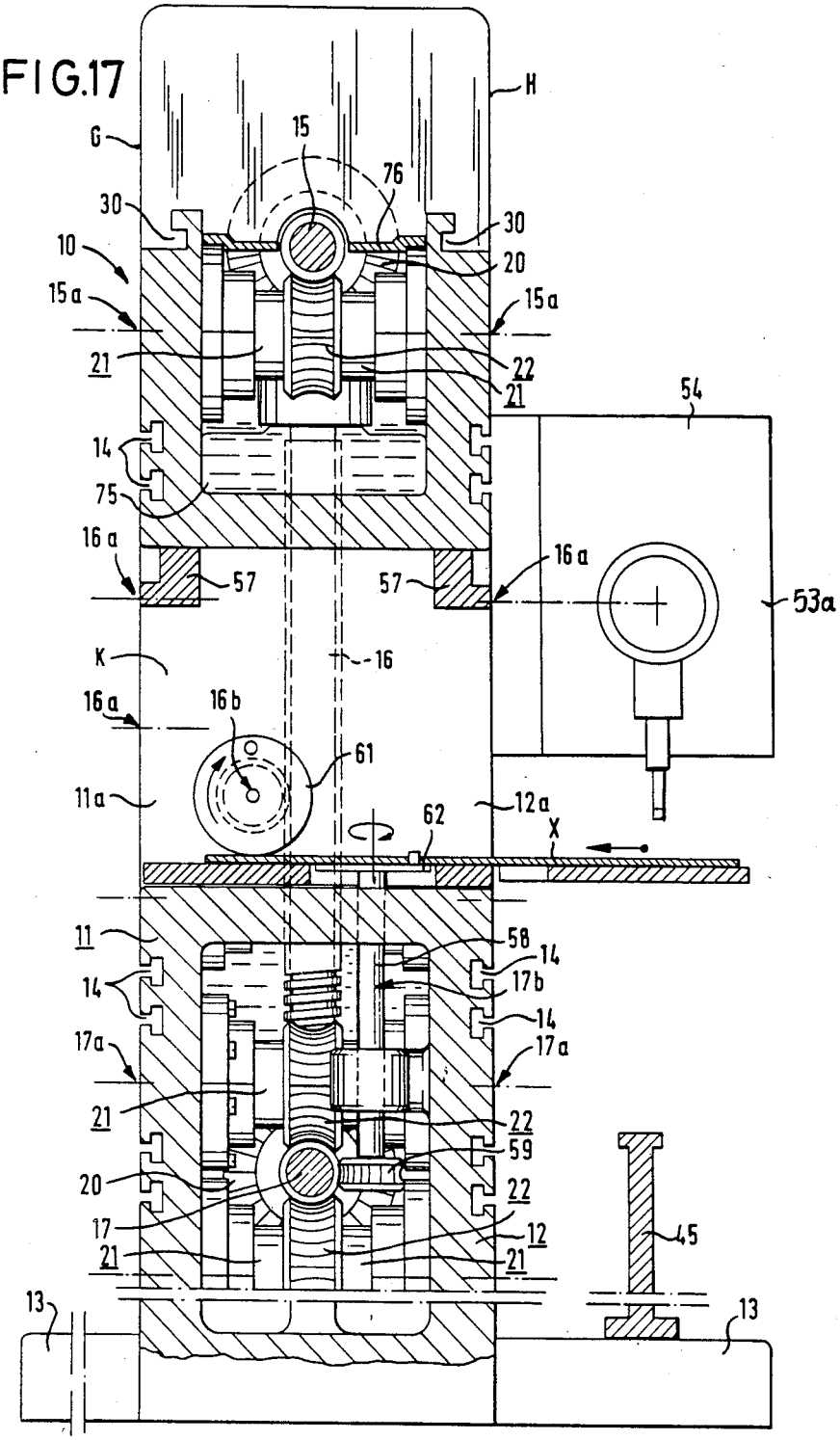
Figure 18:
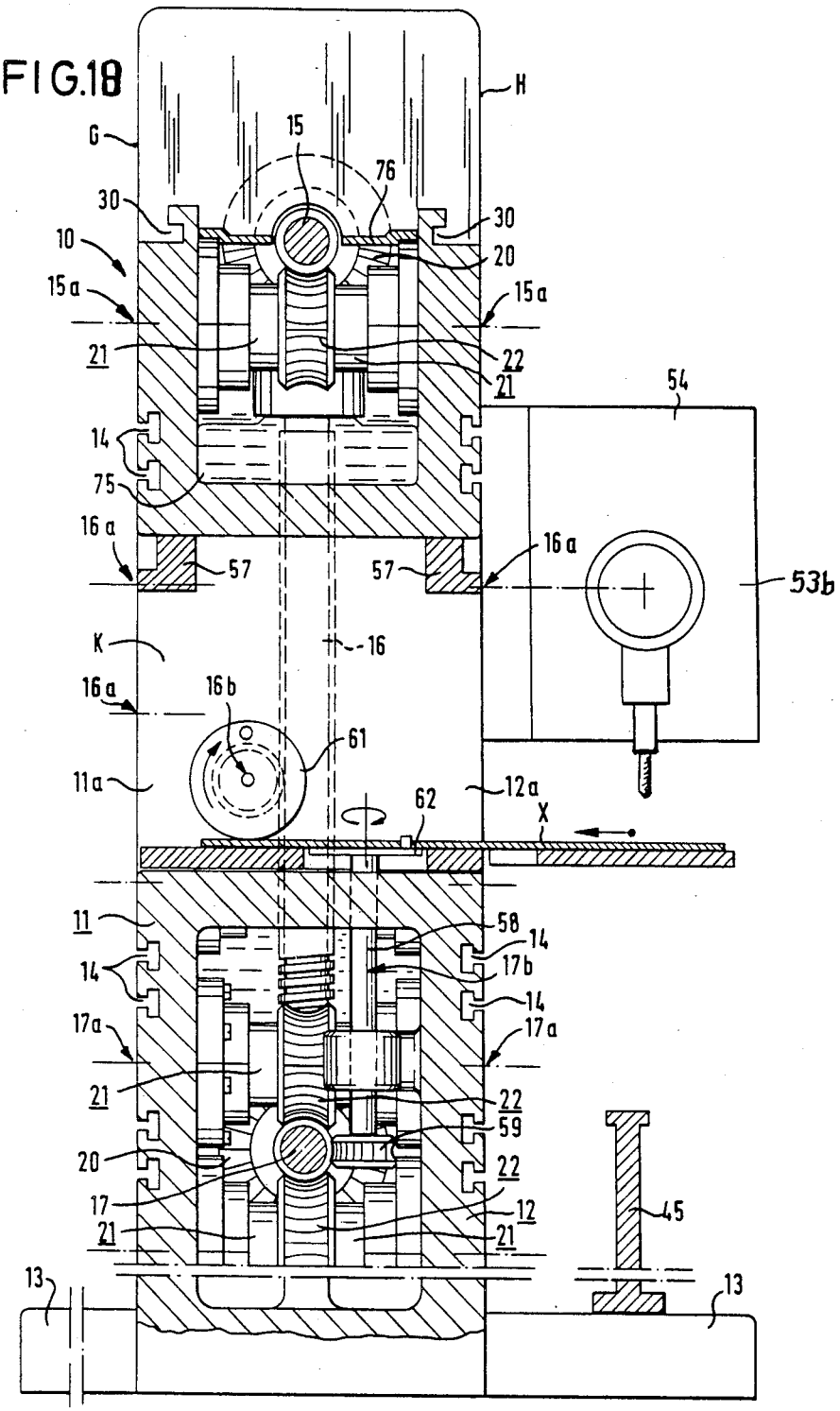

The cut-out shapes punched out of the material strips 28 and 28′ (FIG. 2) by the press 29 can firstly be processed in the region of the main working plane H. For this purpose they are displaced out of the region of the punch press 29 to the respective processing position, by means of intermediate feed devices (not shown) which bring a plate approximately to the location designated by X in FIG. 2. At this location X, various operations can be performed such as: welding operations by means of a welding unit 53*d*, shown in FIG. 16; milling operations by means of a milling unit 53*a*, shown in FIG. 17; drilling operations by means of a drilling unit 53*b*, shown in FIG. 18; or thread cutting operations by means of a thread cutter 53*c*, shown in FIG. 14. The thread cutter 53 and the welding plunger 52 are fitted on a processing unit 54 which is secured on the main processing panel 12 and driven by a main power take-off position 16*a* through an angle drive 55 (FIG. 2). The processing unit 54 can also be fitted, as may be seen from FIG. 4, with a bending unit 56 working obliquely of the main plane H.

It is also possible to feed further strip material in the main working plane H and divide it by further punch presses so that on the side of the main processing plane H different cut-out shapes obtained form different strip materials can be connected with one another.

The workpiece worked on the side of the main processing plane H is then transported into the other main processing plane G in order to be further processed there.

For the transport of the workpieces from the main processing plane H to the main processing plane G the main processing panels 11 and 12 are provided with workpiece passage openings 11*a* and 12*a* (FIGS. 1 and 4) which are aligned with one another. The edges of these workpiece passage openings 11*a* and 12*a* are connected with one another by panels lying in secondary processing planes I, K, L and M standing perpendicularly of the main processing planes G and H. These panels can be cast integrally with the main frame 10. Thus a passage shaft is defined through which the workpieces can pass from the main processing plane H to the main processing plane G. Additional securing means 57 for processing units, for example for bending abutments, can be fitted as may be seen from FIG. 4 on the edges of the workpiece passage openings 11*a* and 12*a*.

Figure 5:
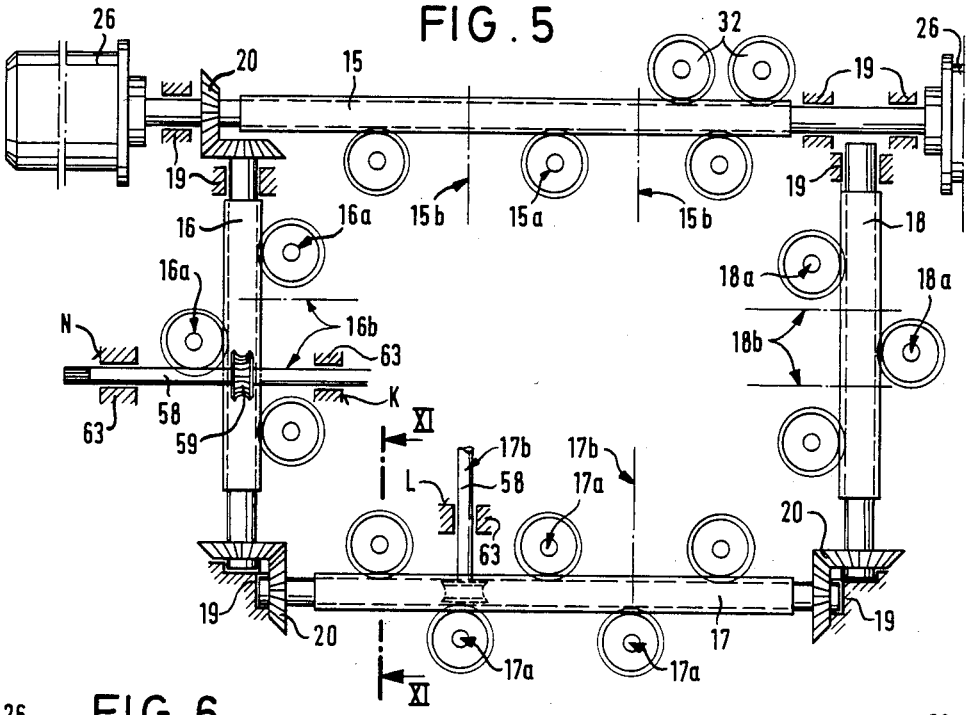
FIG. 5 represents the drive layout of the worm shafts and associated power take-off positions in the machine according to FIG. 1.

As illustrated in FIG. 5, secondary power take-off positions 15*b*, 16*b*, 17*b* and 18*b* are allocated to the secondary processing planes, I, K, L and M. The secondary power take-off position 16*b* according to FIG. 5—and the like is valid for the other secondary power take-off positions—comprises a worm wheel shaft 58 with a worm wheel 59 in engagement with the worm shaft 16. The worm wheel shaft 58 penetrates the secondary processing plane K and a further secondary processing plane N on the outside of the main frame (FIG. 1). The worm wheel shaft 58 can protrude beyond the secondary processing planes K and N as represented in FIG. 1. It can however also terminate in the secondary processing planes K and N and be provided there with coupling devices similar to the coupling device 24 according to FIG. 3. The secondary processing planes K and N are formed by panels which connect the main processing panels 11 and 12 with one another. These panels can be screwed fast on the main processing panels. By way of example in FIG. 3 there is seen a secondary processing panel 60 which corresponds to the secondary processing plane O in FIG. 1.

According to FIG. 1 on the worm wheel shaft 58 within the workpiece passage 11*a*, 12*a* a transport wheel 61 is fitted which constitutes a further intermediate feed device which provides for the feed of the workpiece from the main processing plane H to the main processing plane G. A further correspondingly formed and driven transport wheel is designated according to FIG. 1 by 62, allocated to the secondary processing plane L and driven by the secondary power take-off position 17*b*.

As soon as the workpiece has reached the main processing plane G under the action of the transport wheels 61 and 62, it is further worked there by the bending units 25.

The left end of the worm wheel shaft 58 in FIG. 1 is suitable for the drive of a processing unit for fitting on the secondary processing plane N or an accessory device to be fitted there. Securing means for processing units and the like can also be fitted on the secondary processing planes N and O, for example in the form of undercut grooves.

The worm wheel shaft 58 of the secondary power take-off position 16*b* can be mounted in the secondary processing panels forming the secondary processing planes K and N, as indicated by the bearings 63 in FIG. 5.

Figure 6:
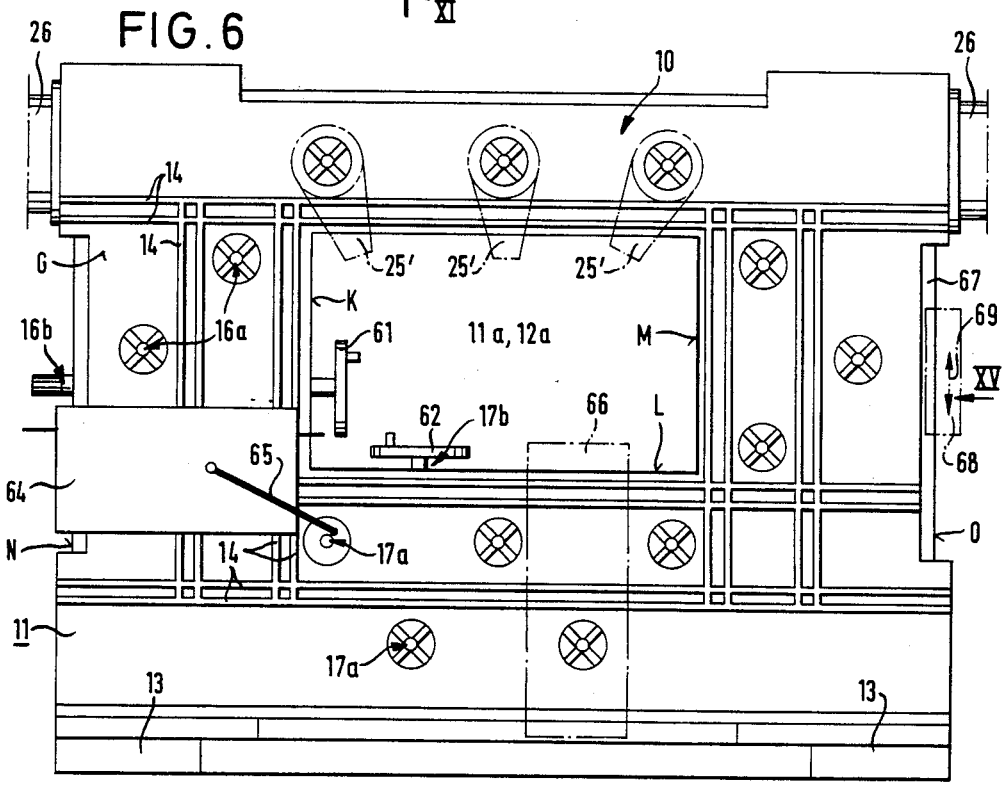
FIG. 6 represents a front view corresponding to that in FIG. 1 with a strip feed unit and with additional continuously adjustable processing units.
Figure 15:
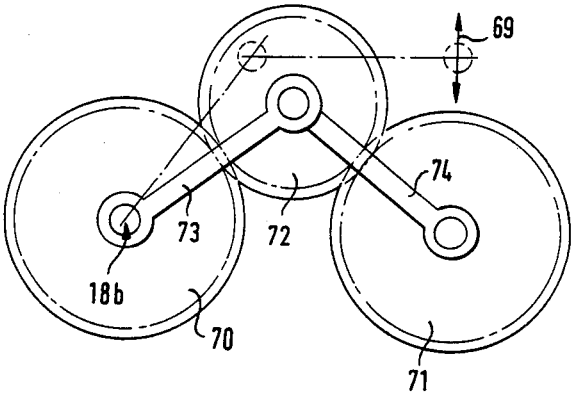
FIG. 15 represents a detail of the arrangement according to FIG. 6 in the direction of the arrow XV in FIG. 6.

As may be seen from FIG. 6, a strip feed unit 64 can also be fitted in the main processing plane G and is driven through a connecting rod drive 65 from a main power take-off position 17*a*. In departure from FIG. 1, FIG. 6 shows on the main processing plane G a plurality of bending units 25' on the upper side of the workpiece passage 11*a*, 12*a*. On the underside of this workpiece passage there is fitted a processing unit 66 displaceable in the longitudinal direction. On the secondary processing plane O a vertical guide 67 is provided for a processing unit 68. This processing unit, for example a strip intake unit, can be continuously displaceable and nevertheless driven by a fixed secondary power take-off position 18*b* (FIG. 5). The direction of displacement is designated by 69 in FIG. 6. FIG. 15 shows what is called a gear drive system; in this case 70 is a toothed wheel connected with the secondary power take-off position 18*b* and 71 a toothed wheel arranged on the processing unit 68. The two toothed wheels 70 and 71 are connected with one another by an intermediate toothed wheel 72. The intermediate toothed wheel 72 is carried by the middle joint of two arms 73 and 74, the other ends of which are pivotable about the axes of the toothed wheels 70 and 71 respectively.

Figure 11:
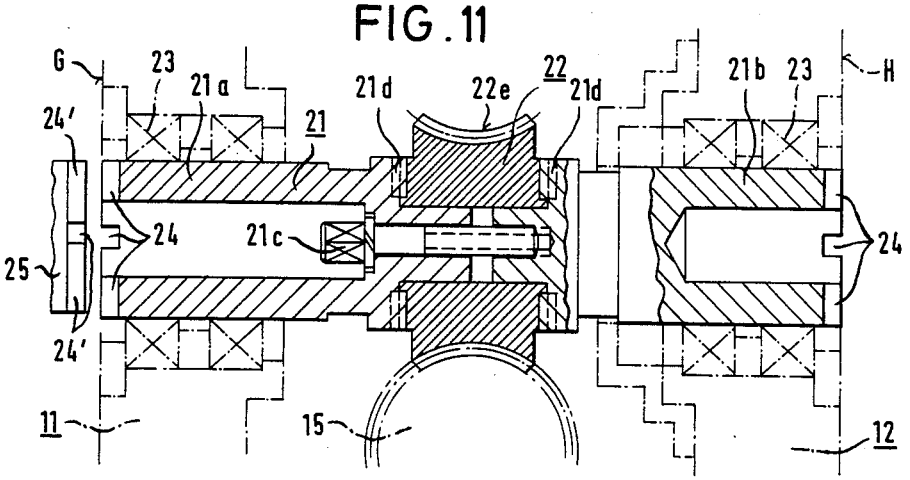
FIG. 11 represents the mounting of a worm wheel shaft in two mutually parallel main processing panels in engagement with the pertinent worm shaft.

In FIG. 11 there is shown in detail the mounting of a worm wheel shaft 21 and the engagement of the worm wheel 22 with the worm shaft 15. The worm wheel shaft 21 consists of two half shafts 21*a* and 21*b* which are carried in the bearings 23 of the main processing panels 11 and 12. The half shafts 21*a* and 21*b* are inserted in to the worm wheel 22 and centered by it. They are held together by a tie bolt 21*c* which is accessible from the side of the main processing plane G. For torque transmission between the worm wheel 22 and the half shafts 21*a* and 21*b*, radial keys 21*d* or splines are provided. The tooth tips 22*e* of the worm wheel 22 are of arcuate curvature with a radius corresponding to the worm root radius of the worm shaft 15. This ensures a great length of engagement between the worm shaft 15 and the worm wheel 22.

For the fitting of the worm wheel 22 this wheel is held in engagement with the worm shaft 15 whereupon the half shafts 21*a* and 21*b* are pushed through the bearings 23 and then secured in the axial direction.

As may further be seen from FIG. 11 the coupling device 24 of the shaft 21 is formed by a cruciform slot. Correspondingly cruciform ribs 24' are provided as countercoupling device on the processing unit 25 to be attached, and engage in the cruciform slots 24. In this way the shaft carrying the cruciform slots 24' of the processing unit 25 to be attached is centered on the shaft 21 and can be mounted in overhung manner in the processing unit.

According to FIG. 3 the main frame 10 is, up to the level of the upper worm shaft 15, a closed hollow frame and accommodates an oil bath 75 into which the worm shaft 15 still partially dips. In this way all the moving parts within the main frame 10 are lubricated. The individual power take-off positions, the main power take-off positions and the secondary power take-off positions, are sealed off by the worm wheel shafts penetrating the pertinent walls, possibly with the use of additional sealing means.

The oil bath is upwardly covered by a cover plate 76 (FIG. 3). This cover plate 76 permits passage of the worm shaft 15 and prevents the entry of dirt.

Figure 7:
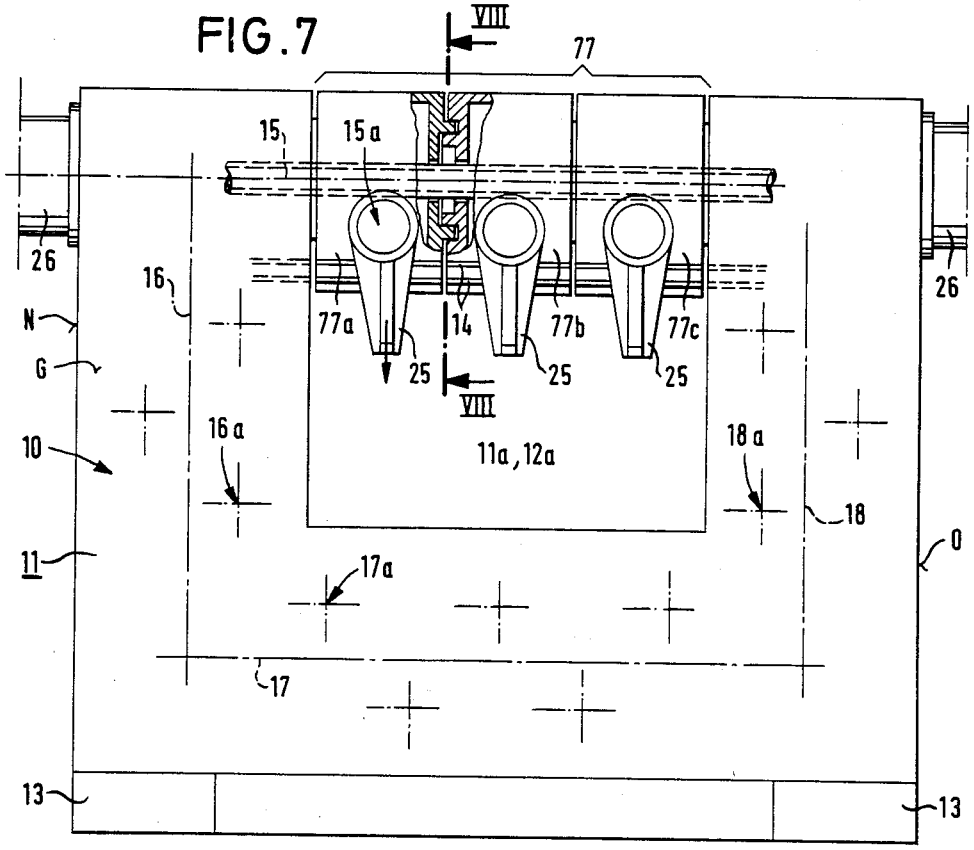
FIG. 7 represents a front view corresponding to that in FIG. 1 in a modified form of embodiment.
Figure 8:
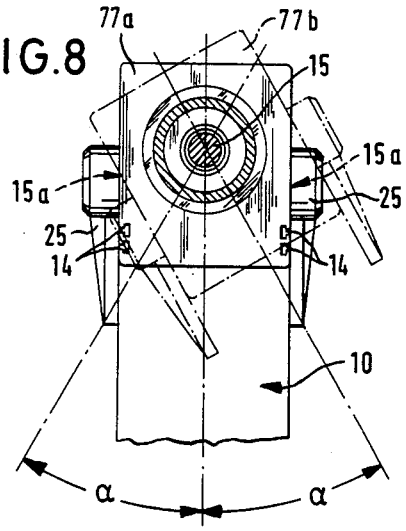
FIG. 8 represents a section along the line VIII—VIII in FIG. 7.

In the modified form of embodiment according to FIG. 7 the main frame 10 is formed above the workpiece passages 11*a* and 12*a* by a beam 77 composed of three sections 77*a*, 77*b* and 77*c*. The beam sections 77*a*, 77*b*, 77*c* are rotatably mounted on the main frame 10 and on one another, namely for rotation about the axis of the worm shaft 15. Worm wheels with worm wheel shafts are mounted in the beam sections 77*a*, 77*b* and 77*c*, the arrangement corresponding to that in FIG. 11. The worm wheels (not shown) are in engagement with the worm shaft 15. As may be seen from FIG. 8 the sections 77*a*, 77*b*, 77*c* can be pivoted individually about the axis of the worm shaft 15 and made fast in any desired intermediate position by securing means (not shown). On the sections 77*a*, 77*b* and 77*c* again securing means in the form of undercut grooves 14 are provided so that bending units 25 or other processing units may be secured. Thus it becomes possible to work with the bending units in any desired working directions.

Figure 12:
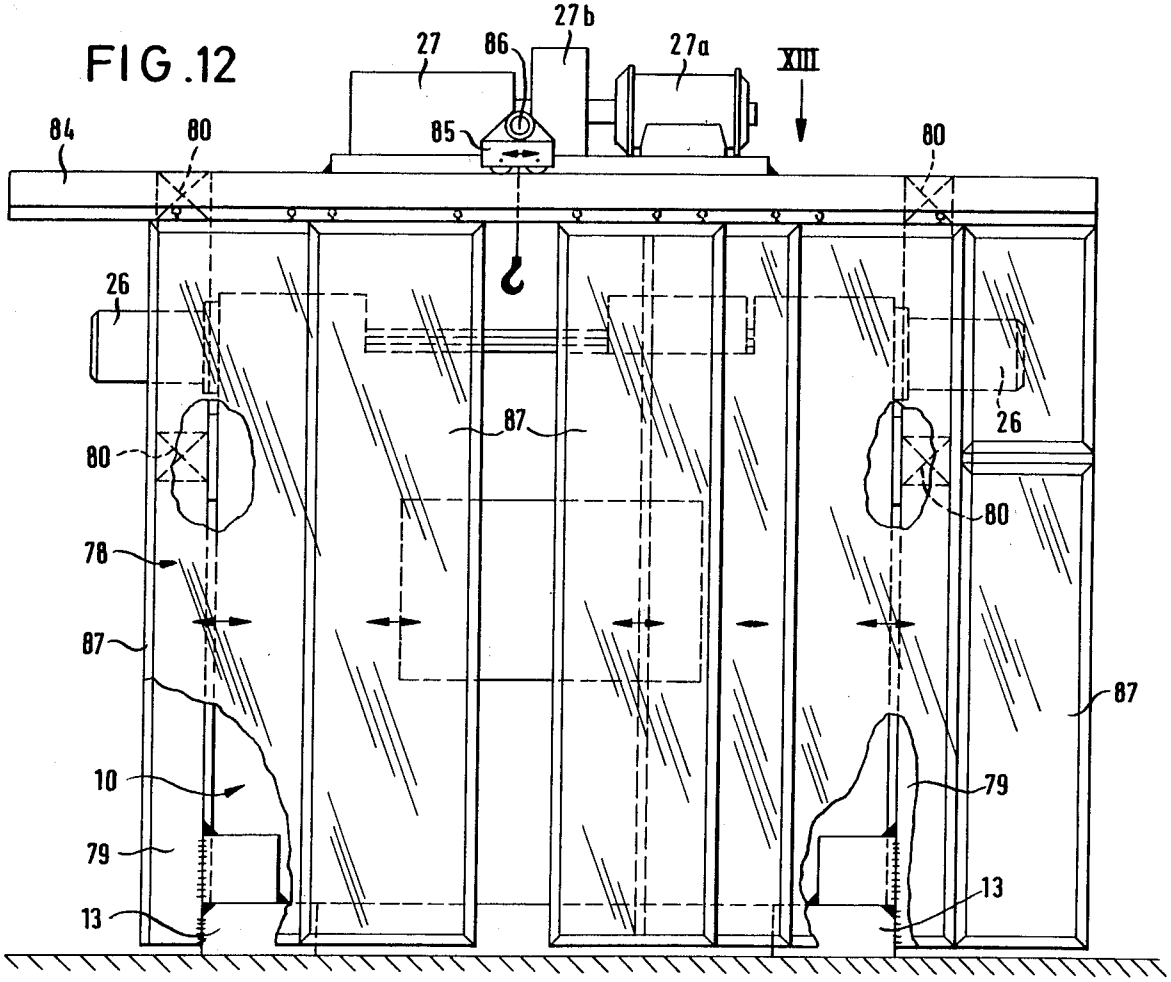
FIG. 12 represents a front view in the direction of view of FIG. 1 in a form of embodiment in which the main frame of the machine is enclosed by an outer support frame and this support frame serves as carrier of a cladding.
Figure 13:
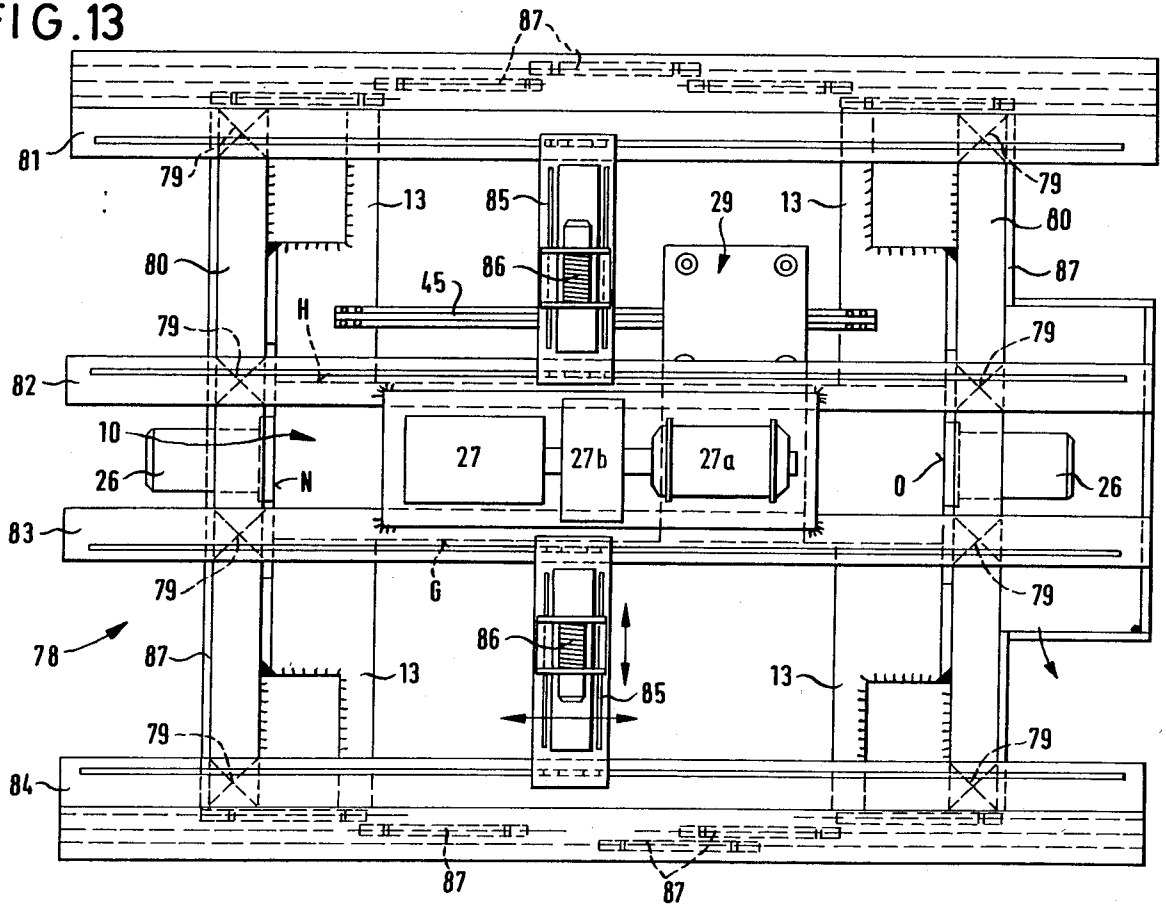
FIG. 13 represents a plan view of the arrangement according to FIG. 12 in the direction of the arrow XIII in FIG. 12.

As may be seen from FIGS. 12 and 13 the main frame 10 is enclosed by a support frame 78. The support frame 78 is of such stout formation that it can suppress vibrations of the main frame 10 in relation to its floor beams 13. The support frame 78 comprises at least four vertical support columns 79 which are connected with one another by transverse girders 80 and longitudinal beams 81, 82, 83, 84. The lower transverse girders 80 are welded to the main frame 10. On the longitudinal beam 81, 82 a first transverse beam 85 is arranged which is mobile along the longitudinal beams 81 and 82. A hoist 86 serving for the handling of processing units in the main processing plane H is mobile on the transverse beam 85 in the longitudinal direction of the transverse beam 85. A corresponding hoist is allocated to the main processing plane G.

As may be seen from FIG. 12, the pressure supply pump 27 which is driven by a motor 27*a* and to which an oil cooler 27*b* is allocated is arranged on the top on the support frame 78.

On the support frame 78 there are arranged cladding parts 87 formed as sliding or pivoting doors which serve for the purpose of labor security as contact protection and possibly also as noise protection. All parts of the machine, with the exception possibly of the strip supply rolls, are accommodated within this cladding. The cladding parts can be produced from transparent material so that observation of the operations on the machine is possible without opening the cladding.

As additional labor protection measure it can be provided that when the frame is opened the machine can run only in inching operation, or not all.

We claim:

1. Workpiece processing machine, comprising a stationary main frame (10) having at least one main processing plane (G, H), worm shafts (15, 16, 17, 18) arranged on the one side of this main processing plane (G, H) with their axes substantially parallel with the main processing plane (G, H), mounted in the stationary main frame (10) and connected with one another for drive, securing means (14) arranged on the other side of the main processing plane for the securing of processing units (25, 29) on the stationary main frame (10), and—allocated to each worm shaft (15, 16, 17, 18)—at least one main power take-off position (15*a*, 16*a*, 17*a*, 18*a*) for the drive connection of a processing unit (25, 29) with the respective worm shaft (15, 16, 17, 18) through a worm wheel (22) meshing with the worm shaft, with a worm wheel axis perpendicular to the main processing plane (G, H), at least three said worm shafts (15, 16, 17, 18) connected for drive being arranged along mutually adjoining sides of a polygonal line, a workpiece passage (11*a*, 12*a*) being provided in the processing plane (G, H) within the polygonal line.

2. Workpiece processing machine according to claim 1, characterised in that the worm shafts (15, 16, 17, 18) are arranged along at least three sides of a rectangular polygonal line.

3. Workpiece processing machine according to claim 2, characterised in that the worm shafts (15, 16, 17, 18) are arranged along the four sides of a rectangle.

4. Workpiece processing machine to claim 1, characterised in that each main power take-off position (15*a*, 16*a*, 17*a*, 18*a*) is constantly occupied, irrespective of the presence of a pertinent processing unit (25), with a worm wheel (22) and an associated worm wheel shaft (21) perpendicular to the main processing plane (G, H), the worm wheel shaft (21) comprising in the region of the main processing plane (G, H) a coupling device (24) for the coupling of a counter-coupling device (24') of a processing unit (25).

5. Workpiece processing machine according to claim 1, characterised in that the main processing plane (G, H) is defined by at least one main processing panel (11, 12) which carries the securing means (14) for the attachment of at least one processing unit (25) and comprises, at an associated main power take-off position (15*a*, 16*a*, 17*a*, 18*a*) a hole for the passage of the drive connection between the respective worm shaft (15, 16, 17) and the processing unit (25).

6. Workpiece processing machine according to claim 5, characterised in that the holes on the main power take-off position (15*a*, 16*a*, 17*a*, 18*a*) is closed by one of a worm wheel (22), a worm wheel shaft (21), and a coupling device (24).

7. Workpiece processing machine according to claim 1, characterised in that the worm shafts (15, 16, 17, 18) are connected with one another by bevel gears (20).

8. Workpiece processing machine according to claim 7, characterised in that four worm shafts (15, 16, 17, 18) are connected with one another by a total of three bevel wheel drives (20).

9. Workpiece processing machine especially according to claim 1, characterised in that the worm shafts (15, 16, 17, 18) are driven by a plurality of drive motors (26) running in synchronism.

10. Workpiece processing machine according to claim 9, characterised in that a drive motor (26) is allocated to each of the two mutually remote ends of at least one worm shaft (15).

11. Workpiece processing machine according to claim 9, characterised in that the drive motors (26) are hydraulic motors driven from a common pressure supply unit (27).

12. Workpiece processing machine according to claim 1, characterised in that the workpiece passage (11*a*, 12*a*,) is substantially rectangular, the defining sides of the rectangular workpiece passage (11*a*, 12*a*) being substantially parallel to the worm shafts (15, 16, 17, 18).

13. Workpiece processing machine, comprising a stationary main frame (10) having at least one main processing plane (G, H), worm shafts (15, 16, 17, 18) arranged on the one side of this main processing plane (G, H) with their axes substantially parallel with the main processing plane (G, H), mounted in the stationary main frame (10) and connected with one another for drive, securing means (14) arranged on the other side of the main processing plane for the securing of processing units (25, 29) on the stationary main frame (10), and—allocated to each worm shaft (15, 16, 17, 18)—at least one main power take-off position (15*a*, 16*a*, 17*a*, 18*a*) for the drive connection of a processing unit (25, 29) with the respective worm shaft (15, 16, 17, 18) through a worm wheel (22) meshing with the worm shaft, with a worm wheel axis perpendicular to the main processing plane (G, H), said at least three worm shafts (15, 16, 17, 18) connected for drive being arranged along mutually adjoining sides of a polygonal line, main power take-off positions (16*a*, 17*a*, 18*a*) being arranged to both sides of at least one of the worm shafts (16, 17, 18) when considering the main processing plane (G, H) in a direction perpendicular thereto.

14. Workpiece processing machine according to claim 13, characterised in that at least one main power take-off position (16*a*, 17*a*, 18*a*) on the one side of the worm shaft (16, 17, 18) is opposite to the gap between two main power take-off positions (16*a*, 17*a*, 18*a*) on the other side of the worm shafts (16, 17, 18).

15. Workpiece processing machine according to claim 1, characterised in that the worm shafts (15, 16, 17, 18) are arranged between two mutually parallel main processing planes (G, H).

16. Workpiece processing machine according to claim 15, characterised in that the main power take-off positions (15*a*, 16*a*, 17*a*, 18*a*) in the two main processing planes (G, H) are aligned with one another by pairs in the direction perpendicular to the main processing planes (G, H).

17. Workpiece processing machine according to claim 16, characterised in that a common worm wheel (22) and a common worm wheel shaft (21), which are mounted with their ends each in a main processing panel (11, 12), are allocated to the main power take-off positions (15*a*, 16*a*, 17*a*, 18*a*) aligned with one another in pairs.

18. Workpiece processing machine comprising a stationary main frame (10) having at least one main processing plane (G, H), worm shafts (15, 16, 17, 18) arranged on the one side of this main processing plane (G, H)) with their axes substantially parallel with the main processing plane (G, H), mounted in the stationary main frame (10) and connected with one another for drive, securing means (14) arranged on the other side of the main processing plane for the securing of processing units (25, 29) on the stationary main frame (10), and—allocated to each worm shaft (15, 16, 17, 18)—at least one main power take-off position (15*a*, 16*a*, 17*a*, 18*a*) for the drive connection of a processing unit (25, 29) with the respective worm shaft (15, 16, 17, 18) through a worm wheel (22) meshing with the worm shaft, with a worm wheel axis perpendicular to the main processing plane (G, H), at least three said worm shaft (15, 16, 17, 18) connected for drive being arranged along mutually adjoining sides of a polygonal line, at least one secondary power take-off position (16*b*, 17*b*, 18*b*) with a worm wheel axis parallel to the main processing plane is allocated to at least one of the work shaft (16, 17, 18).

19. Workpiece processing machine according to claim 18, characterised in that the secondary power take-off position (16*b*, 17*b*, 18*b*) is constantly occupied with a worm wheel (59) and an associated worm wheel shaft (58), irrespective of the presence of a pertinent processing unit, and this worm wheel shaft comprises at least at one end a coupling device for the coupling of a counter-coupling device of a processing unit or the like.

20. Workpiece processing machine according to claim 18, characterised in that at least one secondary processing plane (I, K, L, M, N, O) is provided perpendicularly of the main processing plane (G, H) and in that at least one secondary power take-off position (16*b*, 17*b*, 18*b*) is allocated to this secondary processing plane.

21. Workpiece processing machine according to claim 20, characterised in that the secondary processing plane (I, K, L, M, N, O) is formed by a secondary processing panel (60).

22. Workpiece processing machine according to claim 21, characterised in that securing means for the securing of a processing unit (61, 62, 69) or the like are provided on the secondary processing panel.

23. Workpiece processing machine according to claim 22, characterised in that the secondary processing panel extends between two main processing panels (11, 12).

24. Workpiece processing machine according to claim 23, characterised in that at least two mutually associated edges of workpiece passages (11*a*, 12*a*) of two mutually parallel main processing panels (11, 12) are connected by a secondary processing panel.

25. Workpiece processing machine according to claim 23, characterised in that at least two mutually associated outer circumferential edges of two main processing panels (11, 12) are connected by at least one secondary processing panel (60).

26. Workpiece processing machine comprising a stationary main frame (10) having at least one main processing plane (G, H), worm shafts (15, 16, 17, 18) arranged on the one side of this main processing plane (G, H) with their axes substantially parallel with the main frame (10) and connected with one another for drive, securing means (14) arranged on the other side of the main processing plane for the securing of processing units (25, 29) on the stationary main frame (10), and—allocated to each worm shaft (15, 16, 17, 18)—at least one main power take-off position (15*a*, 16*a*, 17*a*, 18*a*) for the drive connection of a processing unit (25, 29) with the respective worm shaft (15, 16, 17, 18) through a worm wheel (22) meshing with the worm shaft, with a worm wheel axis perpendicular to the main processing plane (G, H), at least three said worm shafts (15, 16, 17, 18) connected for drive being arranged along mutually adjoining side of a polygonal line, at least one (15) of the worm shafts (15, 16, 17, 18) being exposed with at least a part of its circumference on at least a part of its length to the outer space of the frame (10), in that on the main frame (10) parallel with the exposed section of the worm shaft (15) there is provided a linear guide (30) for a continuously displaceable and securable processing unit (29) and in that on this continuously displaceable processing unit (29) there is mounted at least one worm wheel (32) for engagement with the exposed section of the worm shaft (15).

27. Workpiece processing machine according to claim 26, characterised in that the exposed worm shaft (15) is exposed in a direction parallel to the main processing plane (G, H) and in that the worm wheel (32) of the continuously displaceable processing unit (29) stands with an axis perpendicular to the main processing plane (G, H).

28. Workpiece processing machine according to claim 27, characterised in that the continuously displaceable processing unit (29) is of L-shaped formation, seen in the direction of the linear guide (30), with a first leg (29*a*) extending substantially transversely of the main processing plane (G, H), having guide elements for the guidance on the linear guide (30), and on which the worm wheel (32), meshing with the exposed worm shaft (15), of the continuously displaceable processing unit (29) is mounted and having a second leg (29*b*) extending substantially parallel with a 29. Workpiece processing machine according to claim 28, characterised in that the processing unit (29) comprises a punch press.

30. Workpiece processing machine according to claim 29, characterised in that in the second leg (29*ba*, 29*bb*) a press frame is formed having a first press frame post (29*ba*) adjoining the first leg (29*a*) and connected therewith and a second press frame part (29*bb*) apart from the first leg (29*a*) and connected with the first press frame part (29*ba*), at least one eccentric drive shaft (33) being mounted in the first press frame part (29*ba*) and connected for drive with the worm wheel (32), while furthermore in the first press frame part (29*ba*) a ram guide (35) for a press ram (36) is arranged in the longitudinal direction of the second leg (29*b*), while furthermore in the ram guide (35) a press ram (36) is displaceably guide, while furthermore the press ram (36) is connected through at least one connecting rod (37) with the eccentric drive shaft (33), and a press table (38) is arranged on the second press frame part (29*bb*).

31. Workpiece processing machine especially according to claim 30, characterised in that the second press frame part (29*bb*) is connected with the first press frame part (29*ba*) by distance pieces (50) and tie rods (49) under prestress.

32. Workpiece processing machine according to claim 31, characterised in that the distance pieces (50) are distance sleeves which are penetrated each by a tie rod (49).

33. Workpiece processing machine according to claim 31, characterised in that the tie rods (49) extend over the entire length of the second leg (29*b*).

34. Workpiece processing machine according to claim 30, characterised in that the eccentric drive shaft (33) is arranged axially parallel with the worm wheel (32) of the continuously displaceable processing unit (29).

35. Workpiece processing machine especially according to claim 30, characterised in that an end of the eccentric drive shaft (33) remote from the worm wheel shaft (31) of the continuously displaceable processing unit (29) is connected with an additional motor (34), especially a hydraulic motor, which may be connected to the same pressure supply unit (27) as the drive motors (26) of the worm shafts (15, 16, 17, 18).

36. Workpiece processing machine especially according to claim 30, characterised in that a tool clamping plate (39, 44) is arranged displaceably in the working direction of the press ram (36) at least one of the press ram (36) and the press table (38).

37. Workpiece processing machine according to claim 36, characterised in that the tool clamping plate (39, 44) is displaceable by a wedge plate (40) displaceable transversely of the working direction of the press ram (36).

38. Workpiece processing machine according to claim 37, characterised in that the wedge plate (40) is displaceable by a spindle drive (41).

39. Workpiece processing machine according to claim 38, characterised in that a spindle drive motor (42), especially a hydraulic spindle drive motor (42), is associated with the spindle drive (41).

40. Workpiece processing machine according to claim 37, characterised in that the tool clamping plate (38, 44) is connected with the respective one of the press ram (36) and the press table (38) by at least one presser spring (43) which holds the tool clamping plate (39, 44) in engagement with the wedge plate (40) and the wedge plate in engagement with the respective one of the press ram (36) and the press table (38).

41. Workpiece processing machine according to claim 38, characterised by clamping means for clamping the tool clamping plate (39, 44) with respect to the wedge plate (40) and the wedge plate (40) with respect to the respective one of the press ram (36) and the press table (38).

42. Workpiece processing machine according to claim 28, characterised in that the exposed worm shaft (15) runs horizontally along the upper edge of the main processing panel (11, 12) and in that the second leg (29*b*) hangs downwards starting from the first leg (29*a*).

43. Workpiece processing machine according to claim 42, characterised in that the second leg (29*b*) is mounted on a support track (45) extending parallel with the linear guide (30).

44. Workpiece processing machine according to claim 43, characterised in that for the mounting of the second leg (29*b*) on the support track (45) the second leg (29*b*) is provided with at least one support shoe (47) and at least one roller bearing (46) of adjustable height.

45. Workpiece processing machine according to claim 28, characterised in that the first leg (29*a*) and the second leg (29*b*) are produced as separate construction units and connected with one another.

46. Workpiece processing machine according to claim 30, characterised in that at least one of the first press frame part (29*ba*) and the second press frame part (29*bb*) is assembled from sandwich parts (B, C, D), at least one of said press ram (36) and said press table (38) being variable in width.

47. Workpiece processing machine according to claim 28, characterised in that at least one additional power take-off position (51) for a further processing unit is fitted on the first leg (29*a*).

48. Workpiece processing machine according to claim 1, characterised in that the stationary main frame is formed essentially by two main processing panels (11, 12) forming main processing planes (G, H), which are connected with one another by distance members.

49. Workpiece processing machine according to claim 48, characterised in that the distance members are formed at least partially by panels (60) perpendicular to the main processing panels (11, 12), which define secondary processing planes (I, K, L, M, N, O).

50. Workpiece processing machine especially according to claim 1, characterised in that the stationary main frame (10) is formed at least partially as a hollow frame accommodating an oil bath (75).

51. Workpiece processing machine according to claim 50, characterised in that the oil bath (75) reaches at least as far as the highest horizontal worm shaft (15).

52. Workpiece processing machine according to claim 1, characterised by at least one feed unit (64) feeding one of wire and strip materials and preceding a stamping press (29).

53. Workpiece processing machine according to claim 52, characterised in that the feed unit (64) is driven through one of the power take-off positions (17*a*) by one of the worm shafts (17).

54. Workpiece processing machine according to claim 52, characterised in that the feed unit (64) is designed for a feed direction parallel to the main processing plane (G, H).

55. Workpiece processing machine according to claim 52, characterised in that the feed unit 64 is designed for a feed perpendicular to the main processing plane (G, H).

56. Workpiece processing machine especially according to claim 1, characterised by intermediate feed devices (61, 62) for the transport of the sections cut off from one of the strip (28, 28′) and wire materials from one processing position (29) to a further processing position (X).

57. Workpiece processing machine according to claim 56, characterised in that an intermediate feed device (61, 62) is formed for the transport of the sections cut off from one of the strip and wire materials through the workpiece passage (11*a*, 12*a*).

58. Workpiece processing machine according to claim 57, characterised in that an intermediate feed device (61, 62) is formed for the transport of the sections cut off from one of the strip and wire materials from the one main processing plane (H) to the other main processing plane (G) and is driven from a secondary power take-off positions (16*a*, 17*a*).

59. Workpiece processing machine according to claim 1 characterised in that at least one processing unit (68) connected to a specific power take-off position is arranged continuously displaceably on the frame (10) and is connected with a power take-off position (18*b*) through an adjustable gear drive system (70, 71, 72) comprising a group of at least three gears in series namely two terminal gears and a middle gear, said terminal gears meshing with said middle gear and being mounted with their respective axes in respective carriers mounted for swinging movement about the axis of said middle gear.

60. Workpiece processing machine according to claim 1, characterised in that at least one processing unit (25) is formed as a bending unit.

61. Workpiece processing machine according to claim 1, characterised in that at least one processing unit is formed as a welding unit (52).

62. Workpiece processing machine according to claim 1, characterised in that at least one processing unit (54) is formed as one of a drilling unit and milling unit.

63. Workpiece processing machine according to claim 1, characterised in that at least one processing unit (54) is formed as a thread-cutting unit.

64. Workpiece processing machine according to claim 1, characterised in that at least one processing unit (54) is connected to a power take-off position (16*a*) through an angle drive (55).

65. Workpiece processing machine especially according to claim 4, characterised in that the coupling device (24) of a worm wheel shaft (21) is formed as one of a cruciform slot and cruciform rib, the point of crossing of which coincides with the shaft axis.

66. Workpiece processing machine especially according to claim 4, characterised in that the worm wheel shaft (21) consists of two half shafts (21*a*, 21*b*) which are aligned and connected fast in rotation with one another and with the worm wheel (22) by the undivided worm wheel (22) and are mounted outside the worm wheel (22) by bearing arrangement (23) in the main processing panels (11, 12).

67. Workpiece processing machine according to claim 66, characterised in that the half shafts (21*a*, 21*b*) are dimensioned such that they can be introduced in opposite directions through the respective bearing arrangement (23) into engagement with the worm wheel (22) held in the working position in relation to the worm shaft (15).

68. Workpiece processing machine especially according to claim 1, characterised in that the stationary main frame (10) is stabilised by an external support frame (78).

69. Workpiece processing machine according to claim 68, characterised in that the support frame (78) is the carrier of at least one of a contact guard cladding and a sound protection cladding (87).

70. Workpiece processing machine according to claim 69, characterised in that said at least one of said claddings (87) is transparent.

71. Workpiece processing machine according to claim 69, characterised in that said at least one of said claddings (87) is displaceable by sections.

72. Workpiece processing machine according to claim 68, characterised in that the stationary main frame (10) comprises floor support beams (13) extending transversely of the main plane and in that the support frame (78) is connected with the floor support beams (13) in the region of their free ends and with the main frame (10) in its upper region.

73. Workpiece processing machine especially according to claim 68, characterised in that the support frame (78) comprises at least two guide beams (81, 82, 83, 84) arranged above the stationary frame (10) and extending parallel with the main processing planes (G, H), and in that at least one transverse beam (85) extending transversely of the main processing plane (G, H) and displaceable in the longitudinal direction of the guide beams (81, 82, 83, 84) is guided on these guide beams (81, 82, 83, 84), and in that on this transverse beam (85) there is arranged at least one hoist and conveyor means (86) for the handling of processing units in the region of the machine.

74. Workpiece processing machine according to claim 73, characterised in that the hoist and conveyor means (86) is mobile along the transverse beam (85), that is perpendicularly of the main processing plane (G, H).

75. Workpiece processing machine according to claim 73, characterised in that where two main processing planes (G, H) are present the support frame (78) for each main processing plane (G, H) comprises two guide beams (81, 82) and (83, 84) and at least one transverse beam (85), extending between these guide beams, each with a hoist and conveyor means (86).

76. Workpiece processing machine especially according to claim 1, characterised in that a frame beam (77) extending along a worm shaft (15) comprises at least one beam segment (77*a*, 77*b*, 77*c*) pivotable about the worm shaft (15), in which there is mounted at least one worm wheel shaft with a worm wheel engaging in the worm shaft (15) and with at least one power take-off position and on which securing means are provided for at least one processing unit (25).

77. Workpiece processing machine according to claim 1, characterised in that the tooth tips (22*e*) of the worm wheel (22) are of partial arc form and adapted to the worm root diameter of the worm shaft (15).

78. Workpiece processing machine according to claim 5, characterised in that two mutually parallel main processing panels each defining a main processing plane are formed by an integral casting.

79. Workpiece processing machine according to claim 79, characterised in that the mountings (19) for the worm shafts (15, 16, 17, 18) in the casting are formed integrally therewith.

80. Workpiece processing machine, comprising a stationary main frame (10) having at least one main processing plane (G), a drive system including at least one worm shaft (15) arranged on the one side of this main processing plane (G) with its axis substantially parallel with the main processing plane (G) mounted in the stationary main frame (10), securing means (14) arranged on the other side of said main processing plane (G) for the securing of processing units (25, 29) on the stationary frame (10), said processing unit (25, 29) being drivingly connectable with said drive system, at least one subframe (77*a*, 77*b*, 77*c*) being mounted with respect to said stationary main frame (10) about an axis coincident with the axis of said worm shaft (15), said subframe (77*a*, 77*b*, 77*c*) being provided with a subframe processing plane, said subframe processing plane being provided with securing means (14) arranged on the side of said subframe processing plane which is remote from said worm shaft (15), at least one power take-off position being provided within said subframe processing plane for the drive connection of a processing unit (25) with said worm shaft (15) through a worm wheel meshing with said worm shaft (15) with the worm wheel axis perpendicular to said subframe processing plane.

* * * * *